US010344523B2

(12) United States Patent
Staehlin

(10) Patent No.: US 10,344,523 B2
(45) Date of Patent: Jul. 9, 2019

(54) OPPOSING DOOR OPENER

(71) Applicant: John H. Staehlin, Westminster, MD (US)

(72) Inventor: John H. Staehlin, Westminster, MD (US)

( * ) Notice: Subject to any disclaimer, the term of this patent is extended or adjusted under 35 U.S.C. 154(b) by 40 days.

(21) Appl. No.: 15/787,851

(22) Filed: Oct. 19, 2017

(65) Prior Publication Data

US 2019/0119971 A1 Apr. 25, 2019

(51) Int. Cl.

| | |
|---|---|
| ***E05C 7/06*** | (2006.01) |
| ***E05F 17/00*** | (2006.01) |
| ***E05C 19/16*** | (2006.01) |
| ***E05F 15/63*** | (2015.01) |

(52) U.S. Cl.

CPC ..... *E05F 17/002* (2013.01); *E05C 19/166* (2013.01); *E05F 15/63* (2015.01); *E05F 2015/631* (2015.01); *E05F 2017/008* (2013.01); *E05Y 2900/132* (2013.01); *E05Y 2900/136* (2013.01)

(58) Field of Classification Search

CPC ... E05F 17/002; E05F 15/63; E05F 2017/008; E05C 19/166; E05Y 2900/132; E05Y 2900/136; E05Y 2015/631

USPC ... 49/61, 63, 65, 67, 98, 104, 107, 108, 371

See application file for complete search history.

(56) References Cited

U.S. PATENT DOCUMENTS

| | | | | |
|---|---|---|---|---|
| 751,668 | A * | 2/1904 | Moskow | E06B 9/52 16/323 |
| 2,226,274 | A * | 12/1940 | Winship | E06B 3/5027 49/109 |
| 2,286,899 | A * | 6/1942 | Crescentini | E06B 3/2605 160/106 |
| 3,584,413 | A * | 6/1971 | Abrami | E06B 3/5027 49/114 |
| 4,658,545 | A | 4/1987 | Ingham | |
| 5,375,374 | A | 12/1994 | Rohroff, Sr. | |
| 5,507,120 | A | 4/1996 | Current | |
| 6,526,694 | B1 * | 3/2003 | Cosgrove | E05B 65/06 49/163 |
| 6,891,479 | B1 | 5/2005 | Eccleston | |
| 6,910,302 | B2 | 6/2005 | Crawford | |
| 6,941,997 | B2 * | 9/2005 | Butler | E05C 7/02 160/92 |
| 7,681,619 | B2 * | 3/2010 | Ramin | E06B 3/2605 160/107 |

(Continued)

*Primary Examiner* — Jerry E Redman

(74) *Attorney, Agent, or Firm* — Finnegan, Henderson, Farabow, Garrett & Dunner, LLP

(57) ABSTRACT

A track-guided power door operator used to simultaneously open a set of opposing hinged doors is disclosed. The door operator comprises a pair of articulated arm linkages, each pair of which is pivotally mounted at one end to a vertically oriented pivot pin at one end of a guide member and pivotally connected at the other end to a vertically oriented pivot pin of a yoke member of a translating carriage, which is engaged by a horizontal lead screw. Translation of the carriage member due to rotation of the lead screw causes lateral separation between the knuckles of the articulated arm pairs to cause doors contacted by the knuckles to rotate about their respective hinges. The door operator may include a control unit to control operation of the doors. The operator may further include magnetic latches to lock the doors closed.

16 Claims, 5 Drawing Sheets

(56) References Cited

U.S. PATENT DOCUMENTS

| | | | | |
|---|---|---|---|---|
| 8,490,345 | B2 * | 7/2013 | Fields | E05B 65/462<br>49/371 |
| 2013/0269258 | A1 * | 10/2013 | Koch | B64C 1/1469<br>49/67 |
| 2013/0306249 | A1 * | 11/2013 | Morton | E06B 3/2605<br>160/92 |

* cited by examiner

OPPOSING DOOR OPENER

TECHNICAL FIELD

The present disclosure relates to power-operated actuators of entry and exit doors of a dwelling unit where there is one main door and a secondary door, such as a screen or storm door, mounted within a single door frame. The disclosed door opener is especially designed for physically disabled and elderly occupants who require wheelchairs or walking assistance devices, allowing simultaneous operation of the main door and secondary door to facilitate traversing of the doorway by the occupant of the home.

BACKGROUND

For a person living with a disability or for elderly individuals, especially those in wheelchairs or scooters, a double door entry to a home, such as a main door and a screen or storm door, presents a major obstacle. To exit the home, one must first move forward to open the inner door, then move backwards to fully open the inner door, move forward again to open the outer door and lock it in an open position, move backwards again to reach the inner door, move for ward past the threshold again to close the inner door, and then move further out the clear the outer door and unlock it to allow it to return to its closed position. Going back into the home presents a similar challenge, overcome through a reversed sequence of the above operations. Entering or exiting the home while carrying groceries or the like introduces additional steps in the sequence to free up one or both hands and later recollect the items before finally closing both of the doors. Known devices for holding one of the two doors in an open position, as disclosed in U.S. Pat. No. 6,910,302 to Crawford for example, are of minimal help as they still require completion of the full sequence of steps above.

Despite this difficulty, it may still be desirable for disabled individuals to keep the double door configuration in place for their home. Screen doors allow airflow into the home to efficiently regulate temperature while keeping insects and debris out. Storm doors can also protect foe main door from damage. The second door may further add an extra level of security, discouraging intruders by providing an additional barrier to entry. Homeowner associations or other regulations may also prohibit removal of the second door or removal may be too cumbersome for the disabled individual.

One possible solution to assist the physically disabled in traversing the double door entryway of their home includes an automated door actuator that can move a hinged door between its closed and open positions. One example of an automated door opener is disclosed in U.S. Pat. No. 5,507,120 to Current, hereby incorporated by reference. Such openers typically utilize a rotary drive screw to power an arm link that is pivotally attached to the door. Some door operators, such as U.S. Pat. No. 5,375,374 to Rohroff, utilize improved arm configurations to reduce the mechanical force required to open the door. The Rohroff device also discloses the use of rollers in contact with the door. There are also known door opening devices that utilize remotely controlled opening devices such as those disclosed in U.S. Pat. No. 4,658,545 to Ingham and U.S. Pat. No. 6,891,479 to Eccleston.

Automated door openers to date, however, all provide a means for actuating a single door. For double door configurations where a main door and a secondary door are installed within the same doorway, due to space limitations, it would be difficult or impossible to install a second door operator within the same doorway. In light of the foregoing, there is a need for an improved door actuator that allows for simultaneous operation of a set of opposing doors, addressing the needs of the physically disabled or elderly.

The present disclosure is directed to overcoming one or more of the problems set forth above and/or other problems of the prior art.

SUMMARY

A door operating system for simultaneously opening a pair of opposing hinged doors comprises an external guide housing mounted to the door frame between the pair of opposing doors. Disposed within the housing is a lead screw oriented horizontally along the length of the guide housing. A pair of articulated arm linkages are included, each arm pivotally connected on one end to a yoke located near the mounting end of the guide housing and pivotally connected on the other end to a carriage member. Bach linkage comprises two arm members pivotally connected to each other. Preferably, the two arm members are connected by a knuckle roller, each roller making contact with one of the doors.

A drive is included to induce rotational movement of the screw. The carriage member is internally threaded to engage the lead screw, whereby rotation of the screw causes linear translation of the carriage member. As a result, the obtuse angle between the two members of each arm linkages is decreased, thereby causing each arm linkage to apply pressure to the surface of one of the two doors forcing it to pivot about its hinges.

DETAILED DESCRIPTION

Reference will now be made in detail to the present embodiments, examples of which are illustrated in the accompanying drawings. Whenever possible, the same reference numbers will be used throughout the drawings to refer to the same or like parts.

Figure 1:
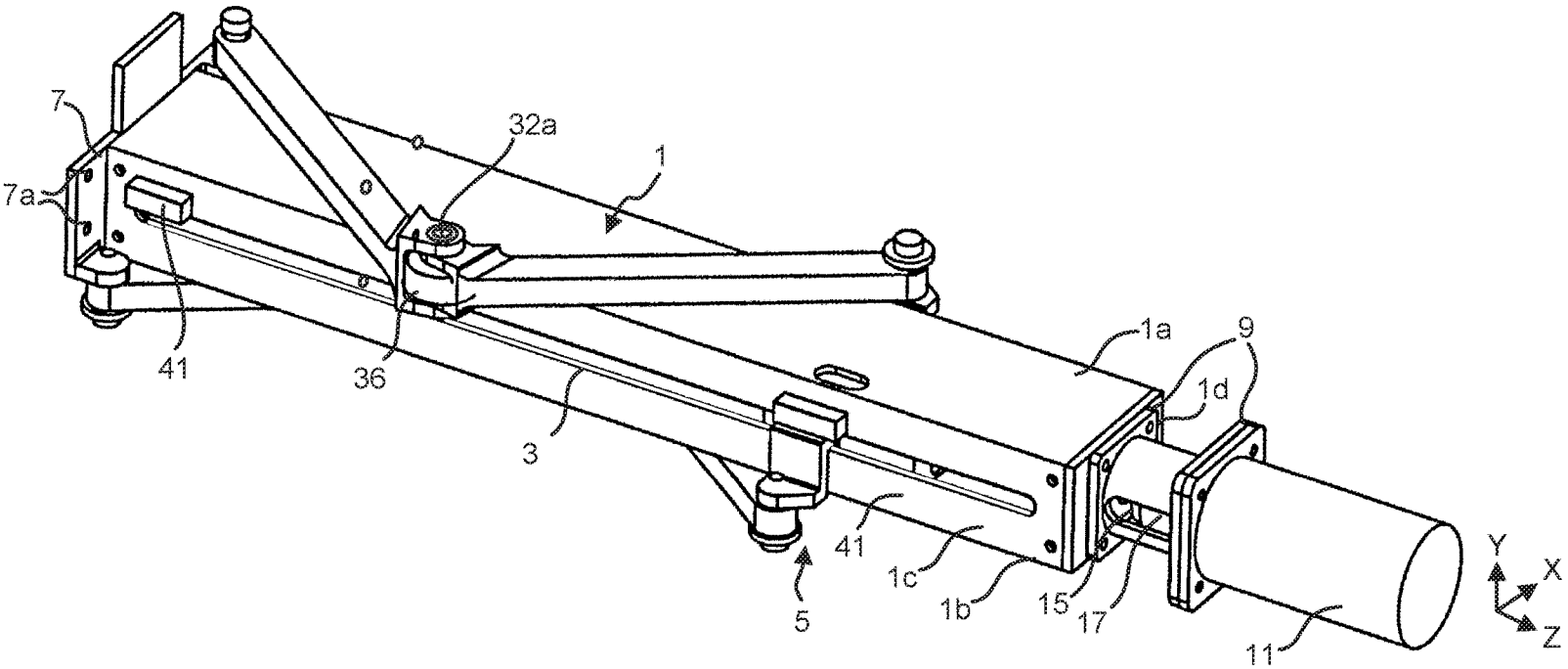
FIG. 1 is an isometric view of the opposing door opening system.

FIG. 1 depicts an exemplary door opener system. The system as shown in FIG. 1 is ready to be mounted to the upper interior of the door frame so that the guide housing 1 is oriented horizontally between the two closed doors (shown more clearly in FIGS. 5A and 5B). The guide housing 1 is a rectangular tube comprising a top wall 1*a*, a bottom wall 1*b* and two side walls 1*c*. Each side wall may feature a guide track cutout 3 to guide the carriage assembly 5 along the length of the guide housing 1. The carriage assembly may also be guided by other sufficient means (e.g., rollers or low friction buttons). The guide housing 1 is closed on each end by lead screw bearing blocks 7 and 9. In the embodiment shown in FIGS. 1 and 2, bearing block 7 comprises mounting holes 7*a* for mounting the opener to the door frame. The opener system may be mounted to the frame in other suitable manners or locations to fit within the frame. A drive, shown generally at 11, is included and mounted to the motor-end bearing block 9.

Figure 2:
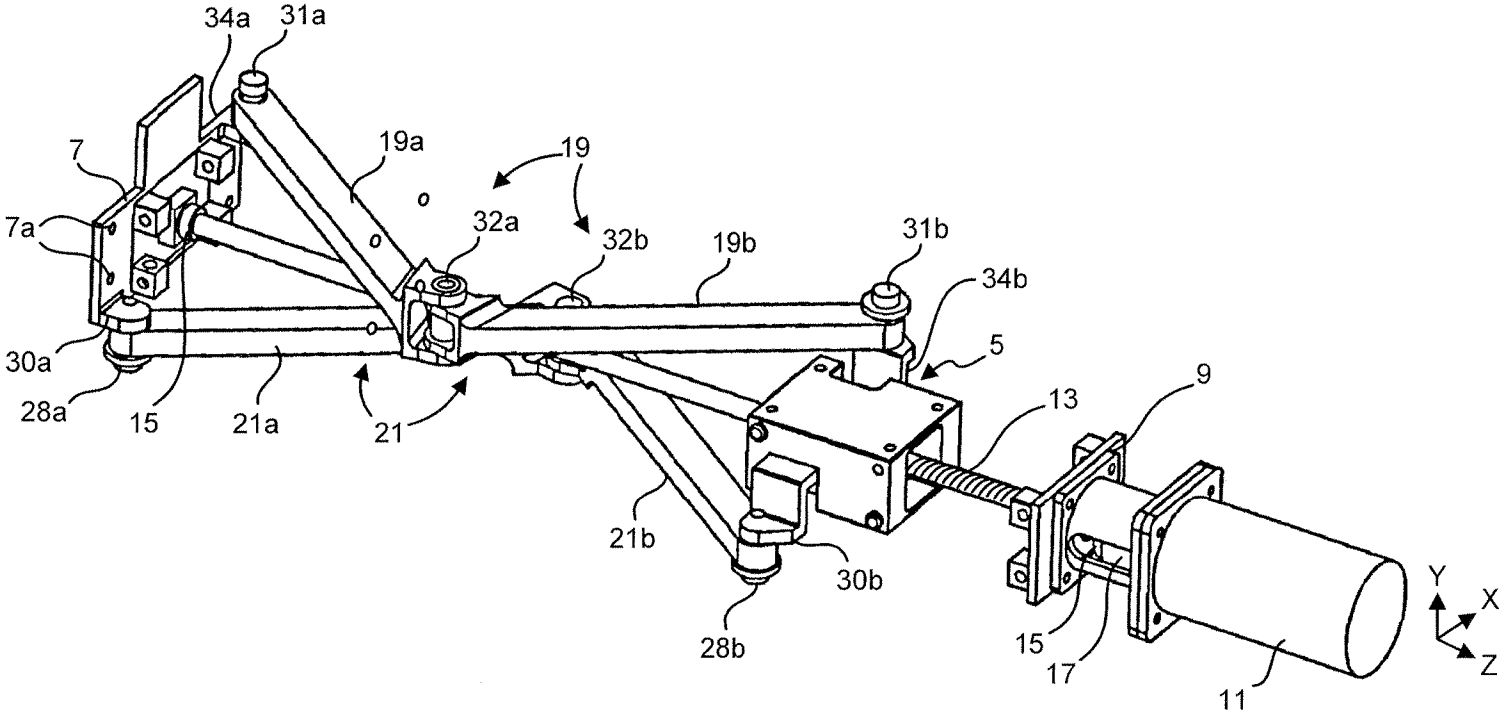
FIG. 2 is an isometric view of the opposing door opening system with the external guide tube housing removed to show the internal components of the system.
Figure 3:
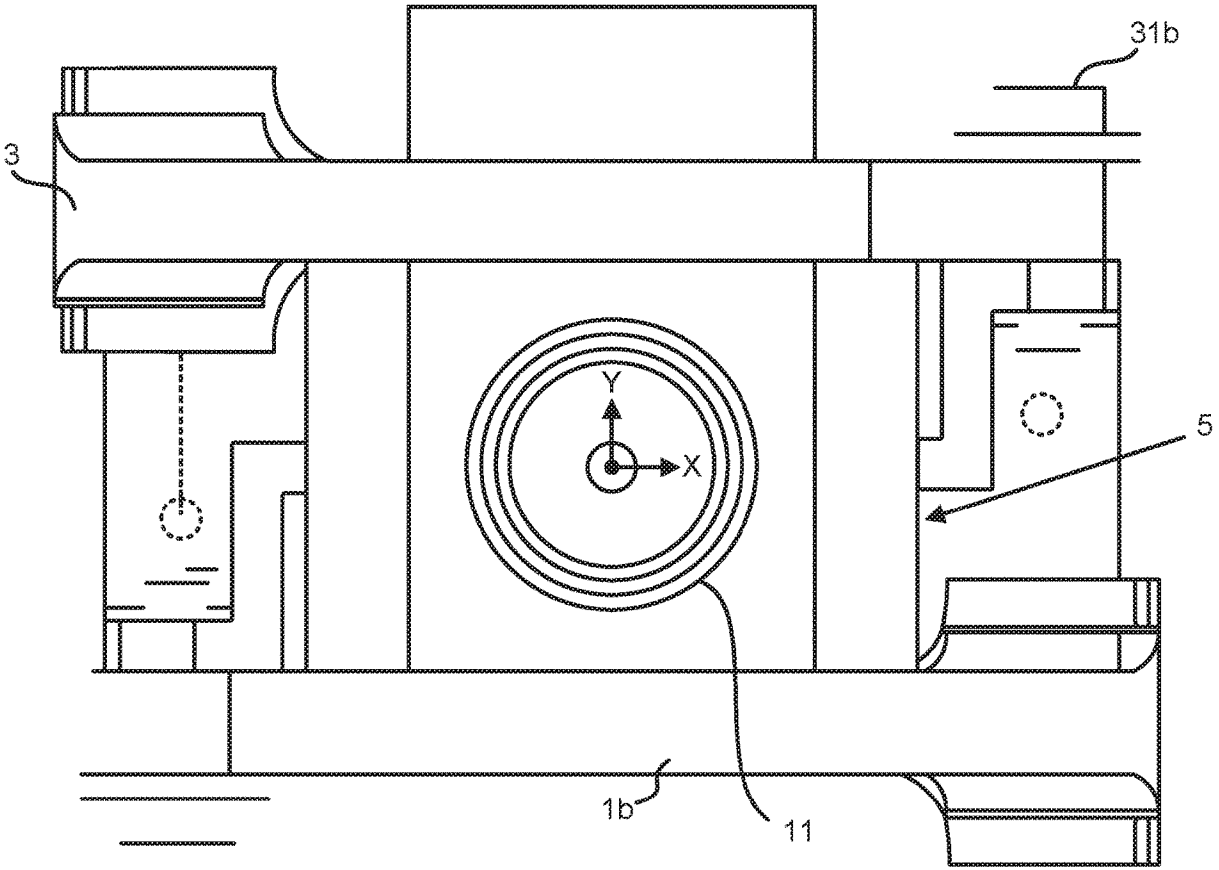
FIG. 3 is an end view of the opposing door opening system along the axis of the drive when the doors are in a closed position.

FIG. 2 depicts the opposing door opener with the guide housing 1 removed to show the internal components of the system. FIG. 3 depicts an end view of the opposing door opener along the axis of the drive 11 when the doors are in a closed position. The door opener includes a threaded lead screw 13 mounted along the center of the guide housing 1. The lead screw 13 is supported on each end by bearings 15, which are contained within the bearing blocks 7 and 9. The drive 11 engages the lead screw 13, to allow the drive 11 to rotate the lead screw 13 about its longitudinal axis Z. A slip clutch 17 may be included to couple the drive 11 to the lead screw 13 to allow rotation of the lead screw 13 during normal operation and limit the maximum torque applied to prevent damage to the lead screw 13.

The door opener system includes a pair of arm linkages 19, 21 free to move along a horizontal plane parallel to the upper door frame member. Each of arm linkages 19,21 comprise two arm members. For example, as shown in FIG. 2, arm linkage 19 may comprise arm members 19*a*, 19*b* and arm linkage 21 may comprise arm members 21*a*, 21*b*. Arm members 19*a*, 19*b* may be connected to each other by vertical knuckle pin 32*a*, and similarly, arm members 21*a* and 21*b* may be connected to each other by vertical knuckle pin 32*b*. Each arm linkage 19, 21 is pivotally connected on one end to bearing block 7. For example, as shown in FIG. 2, arm linkage 21 may be connected to bearing block 7 by shoulder bolt 28*a* and arm linkage 19 may be connected to bearing block 7 by shoulder bolt 31*a*. Arm linkages 19, 21 may be pivotally connected on the opposite end to carriage assembly 5. For example, as shown in FIG. 2, arm linkage 19 may be connected to carriage assembly 5 by shoulder bolt 31*b* and arm linkage 21 may be connected to carriage assembly 5 by shoulder bolt 28*b*. Rotation of the lead screw 13 causes the carriage assembly to translate along the longitudinal axis Z of the lead screw. As a result, the obtuse angle between the two members of each of the arm linkages 19, 21 is decreased.

Figure 5A:
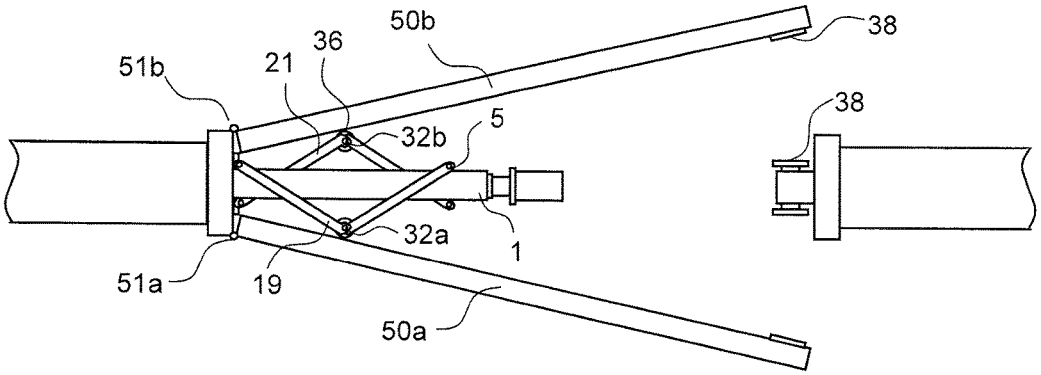
FIG. 5A shows a top view of the opposing door operating system wherein the doors are in a nearly closed position.
Figure 5B:
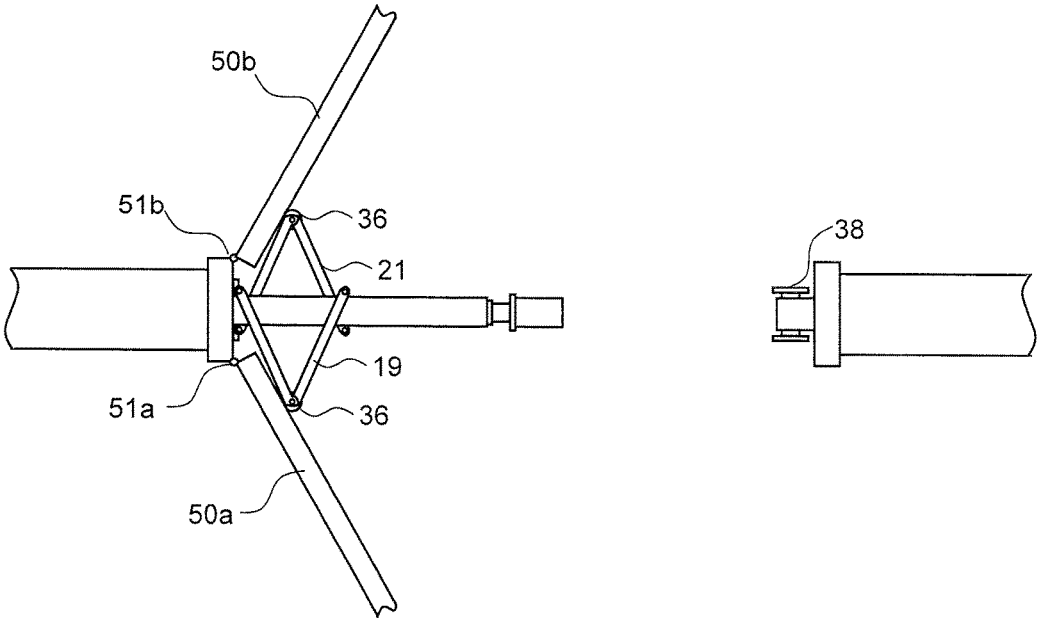
FIG. 5B shows a top view of the opposing door operating system wherein the doors are in a nearly opened position.

FIGS. 5A and 5B show a top view of the door opening system in operation. When the doors are in a closed or nearly closed position, as shown in FIG. 5A, arm linkages 19, 21 may be positioned to form an obtuse angle between arm members 19*a* and 19*b*, and between arm members 21*a* and 21*b*. For example, arm members 19*a* and 19*b* of arm linkage 19 may be positioned such that knuckle pin 32*a* is in close proximity to door 50*a*. Similarly, arm members 21*a* and 21*b* of arm linkage 21 may be positioned such that knuckle pin 32*b* is in close proximity to a second door 50*b*. The door opening system may also include knuckle rollers 36 disposed on knuckle pins 32*a*, 32*b* to provide rolling contact with doors 50*a* and 50*b*. As carriage assembly 5 moves along the length of guide housing 1, the obtuse angle between the two members of the arm linkages 19, 21 is decreased, thereby causing knuckle rollers 36 to move outwards, applying pressure to the surface of doors 50*a*, 50*b*. Accordingly, each door pivots about its respective hinge 51*a*, 51*b*, as shown in FIG. 5B. The door may also be equipped with a suitable known door closure device (e.g., a typical dashpot spring) to maintain door contact with the knuckle rollers 36 during opening and closing operations.

Figure 4B:
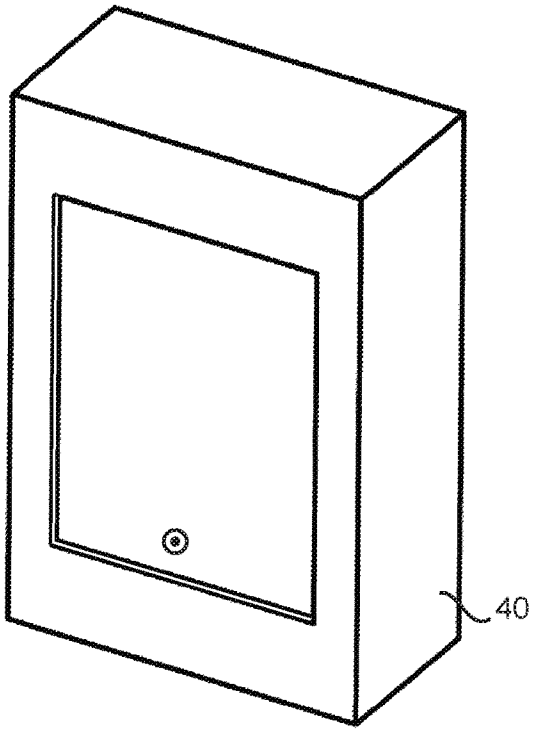
FIG. 4*b* is an exemplary lock box housing a switch to disable the electromagnetic locks and allow entry in the event of an emergency.

In some embodiments, the door opener system may also include a pair of electronically activated magnetic locks 38, as shown in FIGS. 5A and 5B to secure each door against the door frame in a closed position, whereby one component of each of the locks 38 is mounted on the door frame. The electromagnetic locks 38 are configured to release their closure force prior to beginning the opening sequence of the system. An outside lock box 40 (FIG. 4*b*) may be included to house a switch for disabling the electromagnetic locks 38 to allow entry in case of an emergency. An alarm 42 may also be included, triggered when the outside lock box is broken to alert occupants of the home of the entry.

Figure 4:
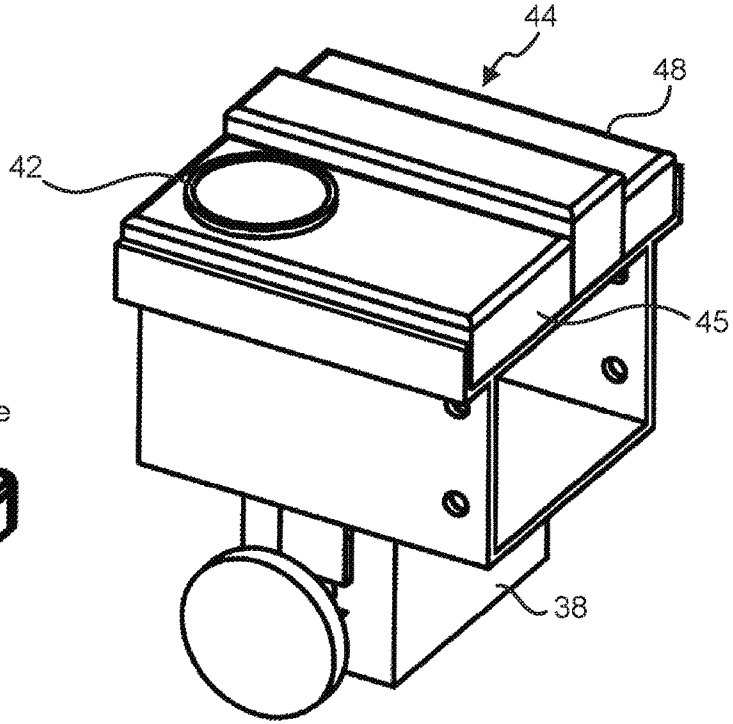
FIG. 4 is an isometric view of the electrical control unit.
Figure 4A:
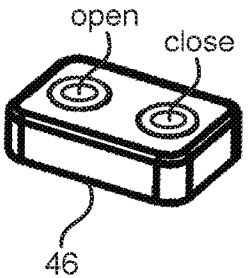
FIG. 4*a* is an exemplary control device for activating the electrical control unit when opening the door.

As shown in FIG. 4, the door opener system of the present invention may be equipped with a control unit 44 in electrical communication with the drive 11, which extends through the control unit 44 and is secured to the motor-end bearing block adjacent to the slip-clutch 17. The control unit 44 includes a suitable microprocessor 45 for controlling the door opener system to open the door. A wireless control device 46, as shown in FIG. 4*a*, may provide the means for the user of the door opener system to open and close the doors. Other suitable signal devices (e.g., a wall switch plate) may alternatively be included to provide the open and close signals to the control unit 44. During operation, upon pressing the "Open" button of the control device 46, the control unit 44 cuts off power to the electromagnetic lock 38 thereby releasing contact force between the magnetic locks 38 and the door frame (not shown). The control unit 44 then applies power to the drive 11 thereby rotating the lead screw 13 to open the opposing doors. A carriage travel limit sensor 41 may be included to trigger the control unit 44 to cut power to the drive 11. Upon pressing the "Close" button of the control device 46, the control unit 44 applies power to the drive 11 in a reverse direction to return the carriage assembly 5 and arm linkages 19, 21 to their original position and close the doors. The microprocessor may also be equipped with a timer to close the doors automatically after a set time delay. A battery backup unit 48 may be included to provide power to operate the doors in the event of a power failure.

It will be apparent to those skilled in the art that various modifications and variations can be made to the opposing door opener of the present disclosure without departing from the scope of the disclosure. Other embodiments will be apparent to those skilled in the art from consideration of the specification and practice of the embodiments disclosed herein. It is intended that the specification and examples be considered as exemplary only, with a true scope of the disclosure being indicated by the following claims.

What is claimed is:

1. A swing door operating system for simultaneously operating a set of opposing hinged doors, each connected by a hinge to a door frame, between open and closed positions, the system comprising:

a guide tube;

a bearing block adapted for mounting on the door frame in a location disposed between the doors and connected to an end of the guide tube;

a lead screw disposed within the guide tube;

a drive configured to rotate the lead screw about a horizontal axis of the guide tube;

a carriage member engaging the lead screw, the carriage member being configured to translate linearly along the horizontal axis upon rotation of the lead screw; and a pair of articulated arm linkages, each of the arm linkages comprising:

a pair of pivotally connected arm members; and a roller pivotally mounted at a point of connection of the arm members so as to provide rolling contact with one of the doors;

wherein the arm linkages are pivotally connected, at first ends of the arm linkages, to the carriage member and pivotally connected, at second ends of the arm linkages, to the bearing block, such that translation of the carriage member in a direction towards the bearing block causes separation between the rollers so as to cause the doors to rotate about their respective hinges in an opening direction.

2. The door operating system of claim 1, further comprising a set of guide rollers in an interior of the guide tube along which the translating carriage rides.

3. The door operating system of claim 1, further comprising a set of low friction buttons along which the translating carriage rides along an interior of the guide tube.

4. The door operating system of claim 1, further comprising a pair of bearings mounted in an interior of the guide tube and supporting the lead screw.

5. The door operating system of claim 1, further comprising a pair of magnetic locks for securing each door in a closed position.

6. The door operating system of claim 1, further comprising:

a set of contacts; and an inline switch energizing the contacts upon opening of the doors to sound an alarm.

7. The door operating system of claim 1, further comprising a pair of adjustable limit switches configured to limit linear travel of the carriage member.

8. The door operating system of claim 1, further comprising a slip clutch coupling the lead screw to the drive, the slip clutch being configured to limit a torque applied to the lead screw.

9. The door operating system of claim 1, further comprising a control unit and at least one sensor configured to generate a signal, the control unit being configured to control the drive based on the signal.

10. The door operating system of claim 9, wherein:

the at least one sensor comprises a travel limit sensor; and the control unit is configured to cut power to the drive based on a signal from the travel limit sensor.

11. The door operating system of claim 9, further comprising a wireless remote control unit sending open and close signals, wherein the control unit is configured to power the drive based on the signals.

12. The door operating system of claim 11, further comprising a pair of magnetic locks for securing the doors against the door frame, wherein the control unit is configured to selectively interrupt power to the electromagnetic latches thereby releasing a restraining force on the doors.

13. The door operating system of claim 12, further comprising an inline switch, wherein the control unit is configured to interrupt power to the latches upon activation of the switch.

14. The door operating system of claim 1, wherein the drive is mounted at a first end of the guide tube.

15. The door operating system of claim 1, wherein the drive comprises a reversible drive for selectively opening and closing the doors.

16. A door operating system for simultaneously operating a pair of opposing hinged doors between open and closed positions, the system comprising:

a guide tube;

a bearing block adapted for mounting on the door frame in a location disposed between the doors and connected to an end of the guide tube;

a lead screw disposed within the guide tube;

a carriage member engaging the lead screw, the carriage member being configured to translate linearly along a horizontal axis of the lead screw upon rotation of the lead screw;

a pair of rollers, each roller making rolling contact with one of the doors; and a pair of articulated arm linkages, each of the arm linkages comprising a first arm member and a second arm member pivotally connected to each other by one of the rollers, the first arm member being pivotally connected to the bearing block and the second arm member being pivotally connected to the carriage member, wherein linear translation of the carriage member causes the doors to rotate about their respective hinges.

* * * * *